US008587158B2

(12) United States Patent
Edwards

(10) Patent No.: US 8,587,158 B2
(45) Date of Patent: Nov. 19, 2013

(54) ILLUMINATED PUSHBUTTON SWITCH WITH CONFIGURABLE ELECTRONIC LATCHING FEATURES

(75) Inventor: Steven A. Edwards, North Richland Hills, TX (US)

(73) Assignee: Aerospace Optics, Inc., Fort Worth, TX (US)

( * ) Notice: Subject to any disclaimer, the term of this patent is extended or adjusted under 35 U.S.C. 154(b) by 441 days.

(21) Appl. No.: 13/041,022

(22) Filed: Mar. 4, 2011

(65) Prior Publication Data

US 2011/0248769 A1 Oct. 13, 2011

Related U.S. Application Data

(63) Continuation-in-part of application No. 12/701,543, filed on Feb. 6, 2010, now Pat. No. 8,222,771.

(60) Provisional application No. 61/207,016, filed on Feb. 6, 2009.

(51) Int. Cl.
*H01H 3/00* (2006.01)

(52) U.S. Cl.
USPC ..... 307/139

(58) Field of Classification Search
USPC ..... 307/139
See application file for complete search history.

(56) References Cited

U.S. PATENT DOCUMENTS 3,969,609 A * 7/1976 Wanner et al. ..... 200/314

* cited by examiner

*Primary Examiner* — Robert L. DeBeradinis

(57) ABSTRACT

Within an illuminating pushbutton switch, an electronic latching circuit replaces an electromagnetic holding coil for latching or releasing a state of the illuminated pushbutton switch. The electronic latching circuit includes inputs receiving clock and reset control signals, one or more outputs delivering latch output states, which may include multiple configurable states, and latch logic controlled by the clock and reset control signals and delivering signals maintaining the illuminated pushbutton switch in a predetermined condition depending upon the latch state. The electronic logic circuit fits within the illuminated pushbutton switch housing in space sized to hold one snap action switching device without increase in the length, weight or mounting depth of the illuminated pushbutton switch.

16 Claims, 5 Drawing Sheets

ILLUMINATED PUSHBUTTON SWITCH WITH CONFIGURABLE ELECTRONIC LATCHING FEATURES

CROSS-REFERENCE TO RELATED APPLICATION(S) AND CLAIM OF PRIORITY

This application is a continuation-in-part of commonly assigned, U.S. patent application Ser. No. 12/701,543 filed Feb. 6, 2010 now U.S. Pat. No. 8,222,771 and entitled ILLUMINATED PUSHBUTTON SWITCH WITH ELECTRONIC LATCHING AND BLINKING FEATURE, and claims priority to commonly assigned U.S. Provisional Patent Application No. 61/207,016, filed Feb. 6, 2009, both of which are hereby incorporated by reference.

TECHNICAL FIELD

The present disclosure is directed, in general, to illuminated pushbuttons switches, and more specifically to implementing electronic latching and blinking features for illuminated pushbutton switches.

BACKGROUND

Within the realm of illuminated pushbutton switch usage, specialized applications are emerging requiring inclusion of latching, blinking or remote control functions to be included within the illuminated pushbutton switch housing. Such applications may require depressing the pushbutton switch to initiate a remote action request, activating switch functions from a remote location, energizing or blinking a local or remote display, and resetting the switch state automatically upon remote acknowledgement. Other applications may involve a plurality of illuminated pushbutton switches in differing locations, all controlling the same functions, wherein a switch depressed at one location must change the state of a switch or display at another location. Other applications may need a single illuminated pushbutton switch to cycle through multiple latched states based on signals from either successive switch presses or from a remote source. Nearly all applications require the added safety feature of an automatic reset to a default state after loss of power.

Proposed designs may incorporate local latching and remote release functions through the use of internal electromagnetic holding coils, in some cases together with various electronic or electromechanical means to interrupt the holding coil current locally without remote intervention. Many of the proposed designs that rely upon an internal electromagnetic holding coil suffer from excessive power consumption, excessive heat, sensitivity to shock and physical jarring, electrical spikes, holding coil drop-out on low voltage, and low reliability. The internal holding coil also makes the resulting illuminated pushbutton switch substantially longer and heavier than standard models that do not incorporate a holding coil.

There is, therefore, a need in the art for improved latching and release in pushbutton switches, together with other features.

SUMMARY

Within an illuminating pushbutton switch, an electronic latching circuit replaces an electromagnetic holding coil for latching or releasing a state of the illuminated pushbutton switch. The electronic latching circuit includes inputs receiving clock and reset control signals, one or more outputs delivering latch output states, which may include multiple configurable states, and latch logic controlled by the clock and reset control signals and delivering signals maintaining the illuminated pushbutton switch in a predetermined condition depending upon the latch state. The electronic logic circuit fits within the illuminated pushbutton switch housing in space sized to hold one or more snap action switching device without increase in the length, weight or mounting depth of the illuminated pushbutton switch.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1A through 4, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system.

Figure 1A:
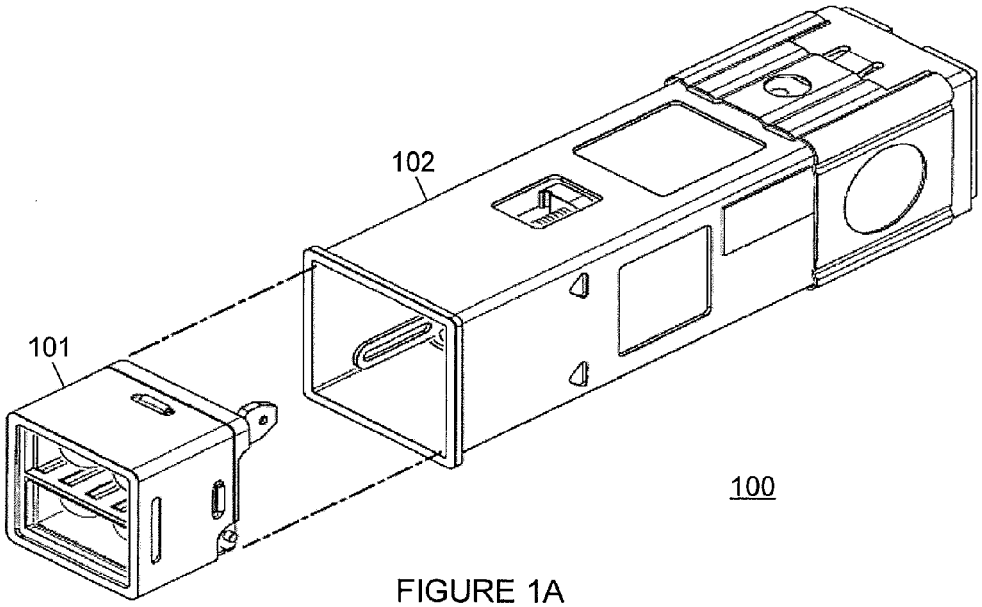
FIGS. 1A, 1B and 1C are exploded perspective views of a pushbutton illuminated switch (or components thereof) with electronic latching and/or blinking according to one embodiment of the present disclosure.
Figure 1B:
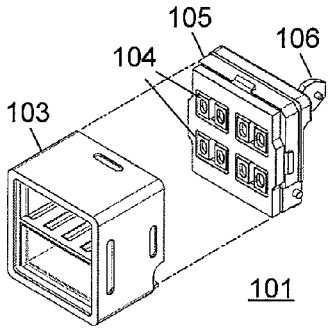
Figure 1C:
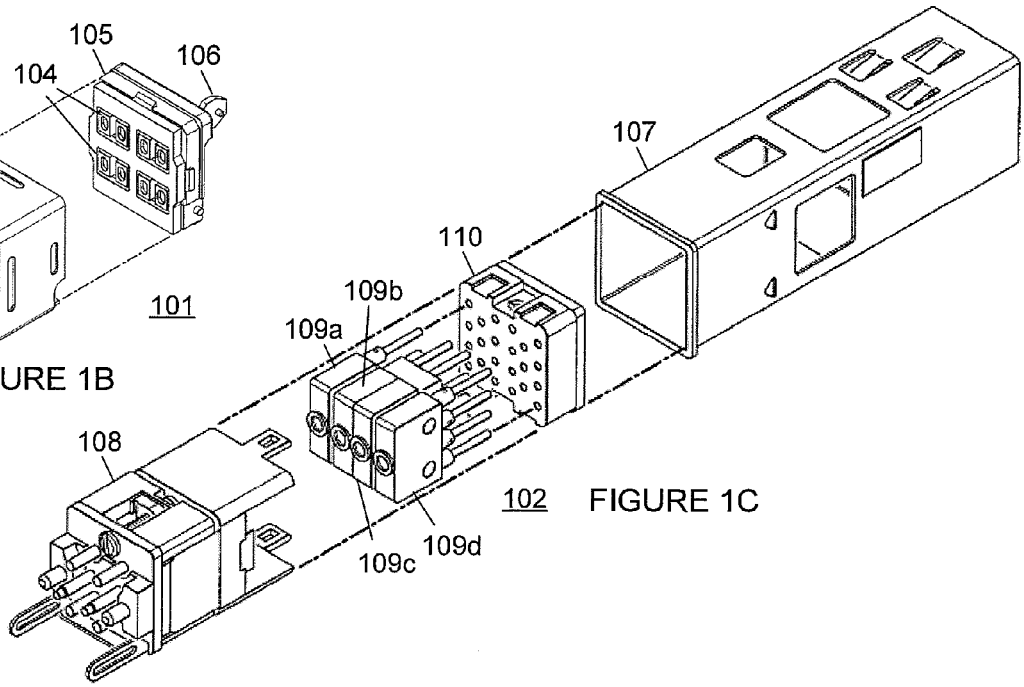

FIGS. 1A, 1B and 1C are exploded perspective views of a pushbutton illuminated switch (or components thereof) with electronic latching and/or blinking according to one embodiment of the present disclosure. The pushbutton switch 100 includes a switch cap 101 and a switch body 102. The switch cap 101 is located at the front of the switch 100 and is received by the switch body 102. The switch cap 101 includes a switch cap housing 103 receiving an array 104 of light sources such as light emitting diodes (LEDs) or incandescent lamps. The 2×4 LED array 104 in the exemplary embodiment has two rows of four surface mount diode (SMD) LEDs arranged to illuminate four quadrants of a face plate (not shown) on the front of switch cap body 103, with two LEDs (a 1×2 subarray) per quadrant. The LEDs are mounted over a switch cap back plate 105 and are connected to an electrical driving circuit (not visible in FIG. 1B) mounted on the switch cap back plate 105. A member 106 for mechanical latching and release of the pushbutton switch when the switch cap 101 is depressed within the switch body 102 protrudes from the rear of switch cap back plate 105. Electrical connections (not shown) to the display driving circuit are also exposed on the rear surface of switch cap back plate 105. The structure depicted and described is consistent with the design of the switch bodies for the 4 pole, models 95, LED (R2) and LR3 pushbutton illuminated switches sold by Aerospace Optics, Inc. of Fort Worth, Tex. Each of the circuits and applications may be housed within such switches in the manner described in further detail below.

In some embodiments, switch body 102 includes a housing 107 receiving a mechanical and electrical subsystem 108 for mechanical latching and release of the pushbutton switch 100, for transmitting electrical signals to the driving circuit, and for transmitting mechanical forces to actuate four-pin snap-action switching devices 109*a* through 109*d*. Pins for the switching devices 109*a* through 109*d* are received by mounting block 110 and provide electrical switching by connections of the pins to external signal sources and/or through the subsystem 108 to the driving circuit. The pins of devices 109*a* through 109*d* extend through the mounting block 110 and may be connected at the rear of pushbutton switch 100 to external signals, to each other, and/or through subsystem 108 to the driving circuit.

Those skilled in the art will recognize that the complete structure and operation of a pushbutton switch of the type normally used in avionics is not depicted or described herein. Instead, for simplicity and clarity, only so much of the structure and operation of a pushbutton switch as is necessary for an understanding of the present disclosure is depicted and described. For example, filters between the LEDs and the switch cap face plate allow legends on the switch cap face plate to be illuminated in different colors as disclosed in U.S. Pat. No. 6,653,798, which is incorporated herein by reference. Numerous other features are also not depicted or described herein are or may be included within pushbutton switch 100.

Figure 1D:
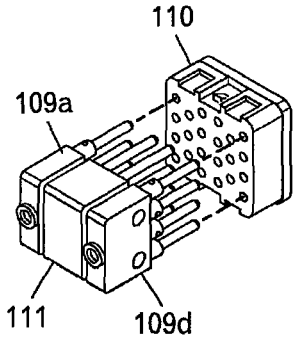
FIGS. 1D and 1E are perspective views illustrating incorporation of an electronic latching and/or blinking module into the pushbutton illuminated switch of FIGS. 1A-1C.
Figure 1E:
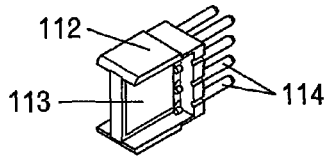

FIGS. 1D and 1E are perspective views illustrating incorporation of an electronic latching and/or blinking module into the pushbutton illuminated switch of FIGS. 1A-1C. As shown in FIG. 1D, an electronic latching and/or blinking module 111 is inserted in place of switching devices 109*b* and 109*c*, with pins received by mounting block 110. FIG. 1E depicts a mounting frame 112 on which integrated electronic circuitry may be mounted, within one of the recesses 113. The electronic module 111 is coupled to a plurality of interface pins 114 (eight in the exemplary embodiment) each extending from the electronic circuitry through a portion of the mounting frame 112 to an endpoint and configured to pass through additional frames or housings (not shown) and engage additional electronic circuitry (not shown), in the same manner as pins for switching devices 109*b* and 109*c*. This approach provides the added functionality of the electronic module 111 with no increase in length, weight or mounting depth while retaining two uncommitted snap-action switching devices 109*a* and 109*d* that can be used to interact with the electronic module 111 or control other system functions.

FIGS. 1F through 1J are perspective views illustrating several alternatives for incorporating configurable electronic latching with multiple latched states into the pushbutton illuminated switch of FIGS. 1A-1C. In the examples shown, the center two snap-action switches 109*b* and 109*c* depicted in FIG. 1C have been replaced with an electronic module 111. In addition, each of these embodiments employs an alternative mounting block 110*a* having a recessed central region surrounded around portions of the peripheral by sidewalls, configured to receive portions of devices 109*a* through 109*d* and/or electronic module 111, as well as portions of a configurable electronic latching module 115*a* or 115*b* when such module replaces one or both of devices 109*a* or 109*d* as depicted and described below. However, the pins of switching devices 109*a* or 109*d*, electronic module 111, and/or configurable electronic latching modules 115*a* or 115*b* still extend through the mounting block 110*a* as previously described.

Figure 1F:
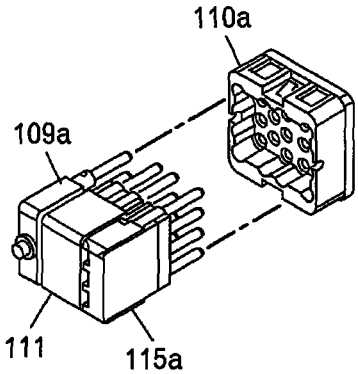
FIGS. 1F through 1J are perspective views illustrating several alternatives for incorporating configurable electronic latching with multiple latched states into the pushbutton illuminated switch of FIGS. 1A-1C.
Figure 1H:
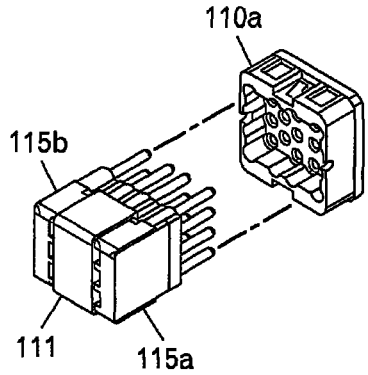
Figure 1G:
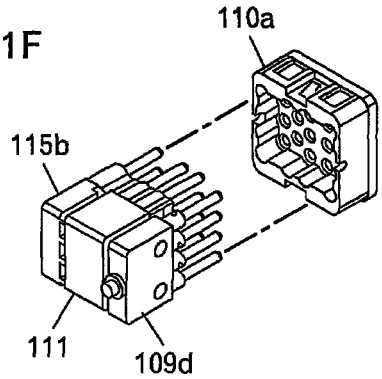

As shown in FIG. 1F, an electronic latching module 115*a* is inserted in place of one of the snap-action switching devices 109*d*, with pins received by mounting block 110*a* (an alternate design to mounting block 110 depicted in FIGS. 1C and 1D). FIG. 1G illustrates substitution of an electronic latching module 115*b* for switching device 109*a*, while FIG. 1H illustrates substitution of electronic latching modules 115*a* and 115*b* for both switching devices 109*d* and 109*a*, respectively. The recessed central region of mounting block 110*a* allows for a more compact structure, taking less space within the pushbutton switch 100, and a mechanically more stable structure.

Figure 1I:
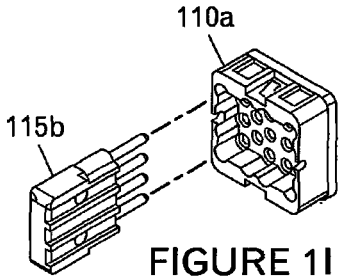
Figure 1J:
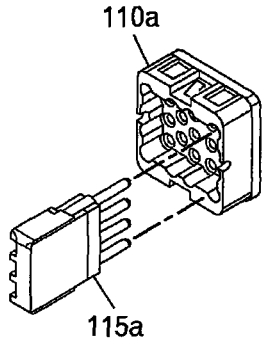

FIGS. 1I and 1J depict just the configurable electronic latching module 115*a* or 115*b*, respectively, and the alternative mounting block 110*a* to better illustrate the outer configuration of configurable electronic latching modules 115*a* and 115*b*. The body of each configurable electronic latching module 115*a* and 115*b* has, at the end from which the pins project, a smaller thickness than a remainder of the body, forming a peripheral lip. The width of the body at that region matches a width of the recessed region of mounting block 110*a*, such that the portion below the lip is received by the recessed central region.

An opposite (inner) face of each configurable electronic latching module 115*a* and 115*b* has grooves. These grooves are complementary to and fit within grooves provided on the adjacent face of electronic latching and/or blinking module 111 in the embodiments of FIGS. 1F through 1J. The grooves may have a dovetail shape, such that the surfaces are fit together by sliding. Regardless, the presence of the complementary grooves improves mechanical strength of the assembly supported by the mounting block 110*a*, such that mounting block 110*a* does not need to provide as much mechanical rigidity to the assembly.

Figure 2:
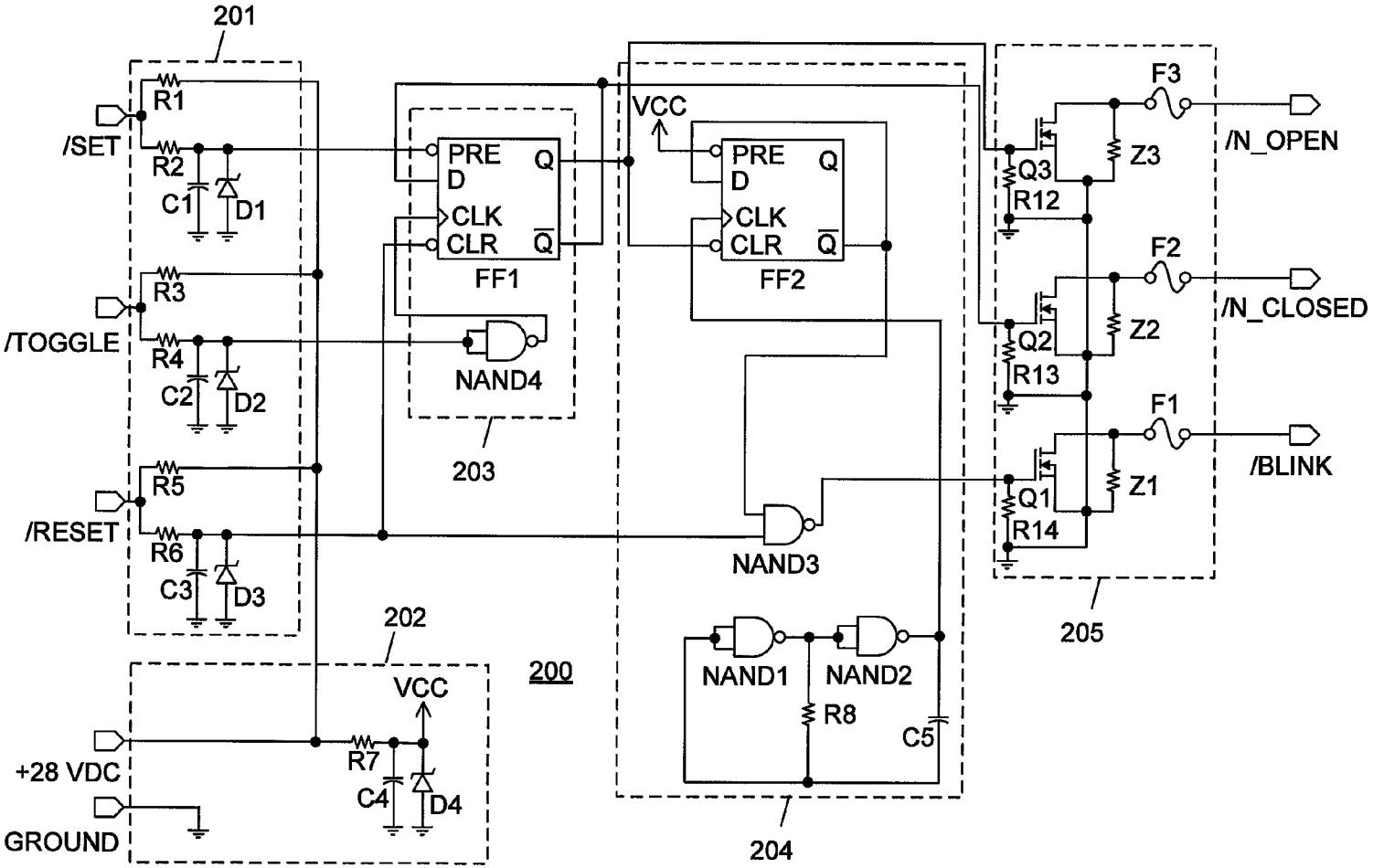
FIG. 2 is a circuit diagram for an electronic latching and/or blinking module according to one embodiment of the present disclosure.

FIG. 2 is a circuit diagram for an electronic latching and/or blinking circuit according to one embodiment of the present disclosure. Electronic latching and/or blinking circuit 200 is contained within the electronic module 111 within switch 100. TABLE I below contains the input and output signal descriptions for circuit 200, while TABLE II describes the logic input and output functions:

TABLE I

| SIGNAL NAME | FUNCTION | ACTIVE STATE | DESCRIPTION |
|---|---|---|---|
| /RESET | Input | Low | Forces /N_OPEN to OFF (open). Forces /N_CLOSED to ON (ground). Forces /BLINK to Steady ON (ground). See Note 1 below. |
| /TOGGLE | Input | ↓ | Toggles /N_OPEN and /N_CLOSED outputs. Toggles blink mode. See Note 2 below. |
| /SET | Input | Low | Forces /N_OPEN to ON (ground). Forces /N_CLOSED to OFF (open). Initiates 1 Hz blink mode to /BLINK output. |
| +28 VDC | Power | — | Power (+10 VDC to +30 VDC) |
| Ground | Common | — | Common for power and signals. |
| /N_OPEN | Output | Low | Open drain output. Forced OFF (open) by /RESET input. Forced ON (ground) by /SET input. Toggled by falling edge of /TOGGLE input. |
| /N_CLOSED | Output | Low | Open drain output. Forced ON (ground) by /RESET input. Forced OFF (open) by /SET input. Toggled by falling edge of /TOGGLE input. |
| /BLINK | Output | Low | Open drain output. Forced ON (ground) while /RESET is held low. See TABLE II below. |

TABLE II

| Inputs | | | Outputs | | |
|---|---|---|---|---|---|
| /SET | /RESET | /TOGGLE | /N_OPEN | /N_CLOSED | /BLINK |
| L | H | X | L (ground) | H (open) | 1 Hz blink mode. |
| H | L | X | H (open) | L (ground) | Steady ON. See Note 1. |
| L | L | X | See Note 3. | See Note 3. | See Note 3. |
| H | H | ↓ | Toggle state. | Toggle state. | Toggle. See Note 1. |

Note 1: /BLINK output is held steady ON (ground) while /RESET is held low. /BLINK output goes OFF (open) when /RESET returns to the inactive high level. This feature provides essentially three states to the /BLINK output: OFF, ON and BLINK.

Note 2: /TOGGLE input causes /BLINK output to alternate between 1 Hertz (Hz) blink state and OFF (open).

Note 3: This is an illegal state that will have unpredictable effect upon the outputs when the inputs are returned to their normal inactive high state.

The logic input circuitry 201 has a total of eight (8) interface pads each connected to an external pin of electronic module 111. Three interface pads are inputs: /SET, /RESET and /TOGGLE. Three interface pads are outputs: /N_OPEN (normally open), /N_CLOSED (normally closed) and /BLINK. Two additional interface pads are devoted to power: +28 VDC (volts, direct current) and Ground.

Each input pad is connected by two parallel resistors: resistors R1 and R2 for input /SET; resistors R3 and R4 for input /TOGGLE; and resistors R5 and R6 for input /RESET. One resistor of each parallel pair (R1, R3 and R5) is connected at the other terminal to the +28 VDC input power. The other resistor of each pair (R2, R4 and R6) is connected to one terminal of a capacitor (C1, C2 and C3, respectively) and to the cathode of a zener diode (D1, D2 and D3, respectively). The other capacitor terminals and the anodes of the zener diodes are connected to ground. Resistors R1, R2, R3, R4, R5 and R6 each have a resistance of 33 kilo-Ohms (KΩ). Capacitor C1 has a capacitance of 0.1 micro-Farads (μF) and each of capacitors C2 and C3 has a capacitance of 1.0 μF in the example depicted.

Each input to circuit 200 includes input filter circuitry designed to protect the integrated circuits from electromagnetic interference (EMI), voltage transients, electromechanical contact bounce and shift the 28 VDC logic level to a 5 VDC logic level. Resistors R2, R4 and R6 and zener diodes D1, D2 and D3 provide EMI protection and voltage transient protection to circuit 200, and shift the 28 VDC logic level to a 5 VDC logic level. Furthermore, complementary metal-oxide-semiconductor (CMOS) latch-up on extreme transients such as lightning or a conducted electromagnetic pulse (EMP) is prevented by clamping the inputs 0.5 VDC below the logic power supply voltage. Capacitors C1, C2 and C3 suppress electro-mechanical contact bounce. Resistors R5 and R6 and capacitor C3 on the /RESET input guarantee a default power-up state for circuit 200 since the power-up time constant of those components is substantially longer than that of both the logic power supply VCC (which has a lower resistance) and the /SET input (which has a much smaller capacitance). Pull-up resistors R1, R3 and R5 establish a default static logic level for the inputs, preventing floating logic states on unconnected inputs.

The logic power supply functional unit 202 generating the logic power supply voltage VCC for circuit 200 includes resistor R7 (which has a resistor of 15 KΩ), zener diode D4 and capacitor C4 (which has a capacitance of 1.0 μF) from the +28 VDC power input. Due to the low operating current of the CMOS logic circuitry within circuit 200, the value of resistor R7 is selected to limit the current of any EMI or voltage transient on the +28 VDC power pad. Transient suppression and voltage regulation on the +5.6 VDC logic power supply is provided by D4 while C4 provides filtering of input and logic transients. Because the logic power supply is a simple shunt voltage regulator, circuit 200 can operate over a wide input voltage range from below +10 VDC to in excess of +30 VDC.

Circuit 200 includes two high speed CMOS integrated circuits: a dual D-Type latch (FF1 and FF2) and a quad Schmidt Trigger NAND gate (NAND1, NAND2, NAND3 and NAND3) implementing the latch logic 203 and the blink circuitry 204. The inverted preset input PRE of latch FF1 is connected by resistor R1 to the /SET input, while the input D of latch FF1 is connected to the inverting output of latch FF1. The clock input CLK of latch FF1 is coupled by NAND gate NAND4, configured as an inverter with the inputs tied together, by resistor R4 to the /TOGGLE input. The inverted clear input CLR of latch FF1 is connected by resistor R6 to the /RESET input. Schmidt Trigger logic gates are used to assure consistent performance on low slew-rate input signals.

Latch FF1 is the primary latching circuit that responds to the inputs /SET, /RESET and /TOGGLE as described in TABLE II above. NAND gate NAND4 is connected between the /TOGGLE input and the clock input of latch FF1 for the purpose of inverting the positive (leading) edge trigger of latch FF1 to a negative (trailing) edge trigger. The inverting output of latch FF1 is connected to the D input so that successive /TOGGLE inputs to latch FF1 result in a toggling action of latch FF1 non-inverting and inverting outputs Q and /Q. The non-inverting output Q from latch FF1 drives the normally open output /N_OPEN via n-channel enhancement mode metal-oxide-semiconductor field effect transistor (MOSFET) Q3, and the inverting output /Q from latch FF1 drives the normally closed output /N_CLOSED via MOSFET Q2. The non-inverting output Q of latch FF1 also holds latch FF2 in the reset state any time latch FF1 is in the reset state.

Blink circuitry 204 includes series connected NAND gates NAND1 and NAND2 configured as inverters with the respective inputs tied together and are interconnected as a dual inverting buffer that, together with resistor R8 (having a resistance of 220 KΩ) connecting a feedback loop from the output of NAND gate NAND2 to the input of NAND gate NAND1 with the input to NAND gate NAND2 and capacitor C5 (having a capacitance of 1.9 μF) connected in the feedback loop, form a free running square wave oscillator with a fundamental frequency F=1/(2.2×R8×C5) of approximately 2 Hertz (Hz). The output of that oscillator feeds the clock input CLK of latch FF2, where the inverting output /Q of latch FF2 is connected to the D input so that latch FF2 functions as f/2 frequency divider. The inverted preset input PRE of latch FF2 is tied to the logic supply voltage VCC. Because the inverted clear input CLR of latch FF2 is connected to the non-inverting output Q of latch FF1, the f/2 divider circuit is effectively disabled any time latch FF1 is in the reset state. The f/2 divided frequency output of latch FF2 creates the 1 Hz blink mode oscillator, enabled only when latch FF2 is in the set state.

The enabled 1 Hertz blink signal from the inverting output /Q of latch FF2 is connected, along with the filtered /RESET input, each to one input of NAND gate NAND3. NAND gate NAND3 thus serves as blink logic, forcing the /BLINK output to be held in a steady ON state any time the /RESET input signal is held low. The output of NAND gate NAND3 is connected to MOSFET Q1 to provide the /BLINK output of circuit 200.

Each output from the circuit 200 includes a power MOSFET Q1, Q2 or Q3 each rated at 2.5 ampere (A) at 45 VDC (both parameters chosen to be substantially greater than operational requirements) and an output filter designed to protect each output device from transients and overload conditions. A pull-down resistor (e.g., 220 KΩ) R12, R13 and R14 is connected to the input of each MOSFET Q1, Q2 and Q3 to ensure that the MOSFETs turn off cleanly should a power-down of the circuit 200 occur under heavy load conditions. Transient protection for the MOSFETs Q1, Q2 and Q3 is provided by impedances Z1, Z2 and Z3, each having a breakdown voltage of 39 VDC. Overload protection may be provided by resettable Positive Temperature Coefficient (PTC) resistors with a holding current of 0.5 A at elevated temperatures between the MOSFETS Q1, Q2 and Q3 and the respective /BLINK, /N_CLOSED and /N_OPEN outputs. Those devices would perform the function of a fuse, limiting current in the event of a short or overload, but automatically returning to their normal state when the short or overload is removed. Preferably, however, 3.0 A fast-acting fuses F1, F2 and F3 are provided to break the circuit in a fail-safe state prior to possible destruction of the MOSFETs from inrush current of an external short circuit condition. In order to provide the highest possible reliability, each output /N_OPEN, /N_CLOSED and /BLINK is derated to a maximum operating current of 0.5 A, or 2.0 A in the embodiment using fast-acting fuses.

Figure 3:
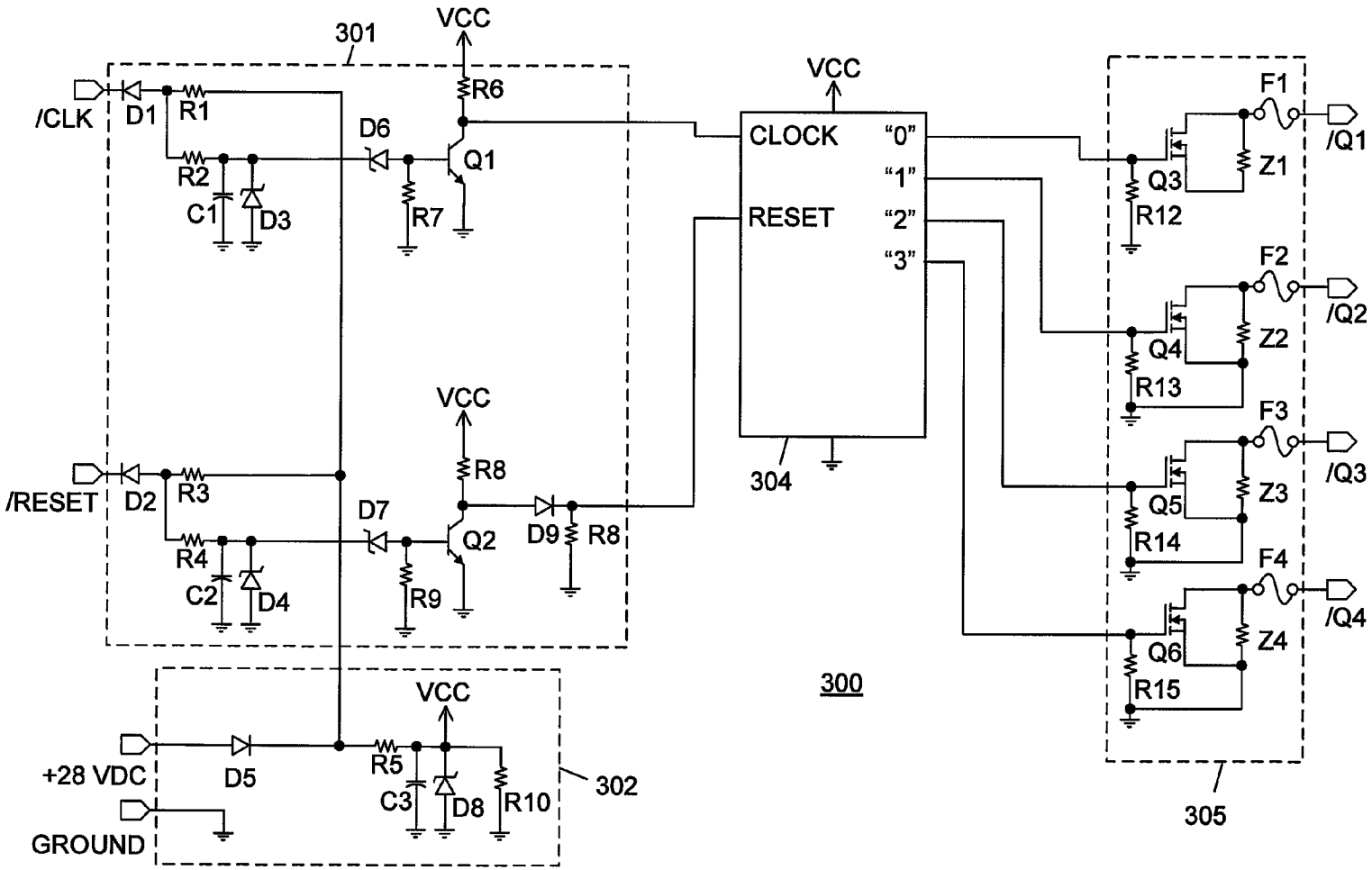
FIG. 3 is a circuit diagram for a configurable electronic latching module providing multiple latched states according to one embodiment of the present disclosure.

FIG. 3 is a circuit diagram for a configurable electronic latching module providing multiple latched states according to one embodiment of the present disclosure. Configurable electronic latching circuit 300 is contained within the configurable electronic latching modules 115*a* and 115*b* when either or both of those modules is mounted within switch 100. TABLE III below contains the input and output signal descriptions for circuit 300, while TABLE IV describes the logic input and output functions:

TABLE III

| SIGNAL NAME | 4-POLE HOUSING PIN | FUNCTION | COMMENTS |
|---|---|---|---|
| /RESET | J1 | Input. Low = Resets to state 1 with /Q1 latched low when held low. | |
| /CLOCK | J2 | High to low transition advances the unit to the next state. | A clock input at state 3 or 4 will return the unit to state 1. |
| +28 VDC | J4 | Power | |
| Ground | K1 | Ground | |
| OUTPUT 1 | K2 | Output: Default = High Impedance (Open Drain); becomes ground for length of pulse | |
| OUTPUT 2 | K3 | Output: Default = High Impedance (Open Drain); becomes ground for length of pulse | |
| OUTPUT 3 | J3 | Output: Default = High Impedance (Open Drain); becomes ground for length of pulse | |
| OUTPUT 4 | K4 | Output: Default = High Impedance (Open Drain); becomes ground for length of pulse | |

TABLE IV

| Inputs | | Outputs | | | |
|---|---|---|---|---|---|
| /RESET | /CLOCK | OUTPUT 1 | OUTPUT 2 | OUTPUT 3 | OUTPUT 4 |
| H | H→L | Output transitions from high impedance (open drain) to ground when state is active. | | | |
| L | L | Output is ground | High Impedance (Open Drain) | High Impedance (Open Drain) | High Impedance (Open Drain) |

The "4-pole housing pin" referenced in TABLE III identifies the corresponding pin of an existing Aerospace Optics 4-pole switch into which the configurable electronic latching module providing multiple latched states is incorporated.

The logic input circuitry 301 for configurable electronic latching circuit 300 has a eight (8) interface pads each connected to an external pin of the configurable electronic latching modules 115*a* or 115*b*. Two interface pads are inputs: /CLK and /RESET. Four interface pads are outputs: /Q1, /Q2, /Q3 and /Q4. Two additional interface pads are devoted to power: +28 VDC (volts, direct current) and Ground.

Each input pad is connected, via a diode D1 or D2, to two parallel resistors: resistors R1 and R2 for input /CLK; resistors R3 and R4 for input /RESET. One resistor of each parallel pair (R1 and R3) is connected at the other terminal to the +28 VDC input power. The other resistor of each pair (R2 and R4)

is connected to one terminal of a capacitor (C1 and C3) and to the cathode of a zener diode (D1 and D3, respectively). The other capacitor terminals and the anodes of the zener diodes are connected to ground. Resistors R1 and R2 each have a resistance of 33 kilo-Ohms (KΩ). Capacitor C1 has a capacitance of 1.0 micro-Farads (μF) and capacitor C2 has a capacitance of 2.2 μF in the example depicted.

Resistors R2 and R4 and zener diodes D1 and D2 provide electromagnetic interference (EMI) protection and voltage transient protection from the respective inputs to circuit 300, and shift the 28 VDC logic level to a 7.5 VDC logic level. Furthermore, CMOS latch-up on extreme transients such as lightning or a conducted EMP is prevented by clamping the inputs 0.5 VDC below the logic power supply voltage. Capacitors C1 and C2 suppress electromechanical contact bounce. Resistors R3 and R4 and capacitor C2 on the /RESET input have a power-up time constant substantially longer than that of both the logic power supply VCC (which has a lower resistance on the 28V power input) and the /CLK input (which has a much smaller capacitance). Those components thus guarantee a default power-up state for integrated circuit 304. In addition, pull-up resistors R1 and R3 prevent floating logic states on unconnected inputs, establishing a default static logic level for the inputs.

Diodes D6, D7 and D9, resistors R6, R7, R8, R9 and R11 (each having a resistance of 33 KΩ), and bipolar junction transistors (BJTs) Q1 and Q2 provide inverting circuits for /CLK and /RESET inputs. The logical signals applied to the /CLK and /RESET inputs are inverted before being applied to integrated circuit 304.

The logic power supply functional unit 302 generating the logic power supply voltage VCC for circuit 300 includes diode D5 connected between the +28 VDC power supply input pad and the power supply connection to other circuit elements within circuit 300. The opposite terminal of diode D5 is connected, via resistor R5 (which has a resistance of 15 KΩ), to a terminal of each of zener diode D8, capacitor C3 (which has a capacitance of 4.7 μF), and resistor R10 (which has a resistance of 220 KΩ). Transient suppression and voltage regulation on the +7.5 VDC logic power supply is provided by D8 while C3 provides filtering of input and logic transients. Because the logic power supply is a simple shunt voltage regulator, circuit 300 can operate over a wide input voltage range from below +10 VDC to in excess of +30 VDC.

Circuit 300 includes a high speed CMOS integrated circuit 4-stage Johnson counter 304. Counter 304 is the primary latching circuit that responds to the logic inputs /CLK and /RESET as described above. The "0," "1," "2" and "3" outputs of counter 304 are coupled to outputs /Q1, /Q2, /Q3 and /Q4. In the default condition, output /Q1 is low with all other outputs /Q2, /Q3 and /Q4 having high impedance. Each /CLK input pulse will increment the counter 304 and rotate the outputs /Q1, /Q2, /Q3 and /Q4 through each state—that is, the next output goes low and the previous output returns to high impedance. Thus, after the /CLK input is pulsed once, output /Q2 goes low and outputs /Q1, /Q3 and /Q4 have high impedance. After the /CLK input has been pulsed twice, output /Q3 goes low and outputs /Q1, /Q2 and /Q4 have high impedance. After the /CLK input has been pulsed three times, output /Q4 goes low and outputs /Q1, /Q2 and /Q3 have high impedance. Pulsing the /CLK input four times will cycle the outputs /Q1, /Q2, /Q3 and /Q4 through all four states, returning to the default condition to restart and repeat the cycle. Pulsing the /RESET input at any time restores the default condition.

Outputs "2" or "3" from the counter 304 may be routed and combined by a logical OR with the /RESET input, allowing the circuit 300 to act as a two state, three state or four state latch. An external jumper may provide the requisite connection. Thus, for example, if the output "3" of counter 304 4 is externally connected to the /RESET input, the circuit 300 operates as a three position latch with output "3" resetting the circuit 300 back to the default condition.

Each output pad /Q1, /Q2, /Q3 and /Q4 is coupled to an output of the counter 304 through a power MOSFET Q3, Q4, Q5 and Q6 rated at 4.0 ampere at 45 VDC, voltage and current parameters that are substantially greater than operational requirements. Transient protection for the MOSFETs is provided by impedances Z1, Z2, Z3, and Z4 with a breakdown voltage of 39 VDC. The input of each MOSFET Q3, Q4, Q5 and Q6 is coupled to ground by a resistor R12, R13, R14 and R15 having a resistance of 220 KΩ. Overload protection may be provided by 3.0 A fast-acting fuses F1, F2, F3 and F4 providing fail-safe protection as described above. In order to provide the highest possible reliability, each output is derated to a maximum operating current of 2.0 ampere.

Figure 4:
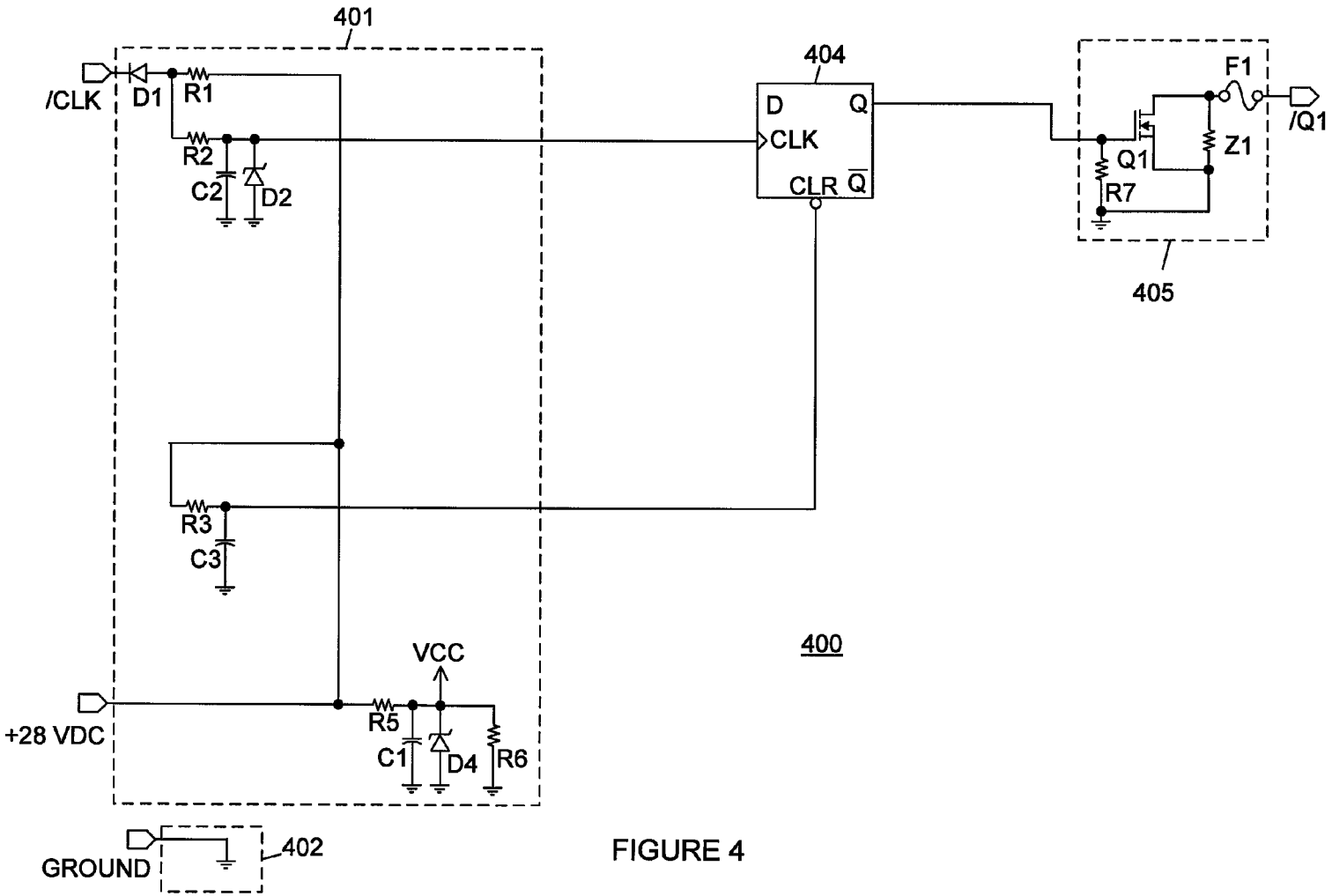
FIG. 4 is a circuit diagram for a single-state electronic latching module according to one embodiment of the present disclosure.

FIG. 4 is a circuit diagram for a single-state electronic latching module according to one embodiment of the present disclosure. Single-state electronic latching circuit 400 is contained within the configurable electronic latching modules 115*a* and 115*b* when either or both of those modules is mounted within switch 100.

The logic input circuitry 401 for configurable electronic latching circuit 400 has four (4) interface pads each connected to an external pin of the configurable electronic latching modules 115*a* or 115*b*. Two interface pads are inputs: /CLK and +28 VDC. One interface pad is an output /Q1. One additional interface pad is devoted to power: Ground.

The input pad for the /CLK signal is connected, via a diode D1, to two parallel resistors R1 and R2, each having a resistance of 33 KΩ. One resistor R1 is connected at the other terminal via resistor R3 (having a resistance of 133 KΩ) to the clear input of flip-flop 404, to the /RESET input pad. The other resistor R2 is connected to one terminal of a capacitor C2 (having a capacitance of 1.0 μF) and to the cathode of a zener diode D2. The clear input to flip-flop 404 is also connected to one terminal of a capacitor C3 (having a capacitance of 2.2 μF). The other capacitor terminals and the anodes of the zener diodes are connected to ground.

The logic power supply functional unit 402 for circuit 400 includes a connection to the ground input pad.

Circuit 400 includes a flip-flop 404 receiving the /CLK signal at a clock input thereof. The non-inverting output of flip-flop 404 is coupled to output /Q1. Output pad /Q1 is coupled to the output of the flip-flop 404 through a power MOSFET Q1 rated at 4.0 ampere at 45 VDC, voltage and current parameters that are substantially greater than operational requirements. Transient protection for the MOSFET is provided by impedance Z1 with a breakdown voltage of 39 VDC. The input of MOSFET Q1 is coupled to ground by a resistor R7 having a resistance of 220 KΩ. Overload protection may be provided by a fuse F1. In order to provide the highest possible reliability, the output is derated to a maximum operating current of 2.0 ampere.

The features of activating switch functions from a remote location, energizing or blinking a local or remote display, resetting the switch state automatically upon remote acknowledgement, changing the state of a switch or display at one location based on another, remote switch controlling the same function being depressed, automatic reset to a default state after loss of power, multi-state configurable electronic latching and single-state electronic latching are implemented in the present disclosure by replacing the traditional electromagnetic holding coil within the illuminated pushbutton switch housing with one or more subminiature electronic logic modules. The logic modules provide many additional features beyond the simple latching or on/off toggling functionality that is typical of an electromagnetic holding coil, including lower size and weight, longer switch life, no electrical spikes, remote set and reset capability, display blinking, and high reliability electronic driver circuits that can drive modest electrical loads.

Although the above description is made in connection with specific exemplary embodiments, various changes and modifications will be apparent to and/or suggested by the present disclosure to those skilled in the art. It is intended that the present disclosure encompass all such changes and modifications as fall within the scope of the appended claims.

What is claimed is:

1. A circuit for latching an illuminating pushbutton switch comprising:

inputs receiving a clock control signal and one or both of set and reset control signals;

one or more outputs delivering one or more latch output signals;

integrated circuit latch logic controlled by the clock and reset control signals, one or more outputs of the latch logic generating the latch output signals and selectively connected to control a condition of the illuminated pushbutton switch, wherein the circuit fits within a housing for the illuminated pushbutton switch within a space sized to hold a snap action switching device, and the inputs and outputs are coupled to external pins from the illuminated pushbutton switch.

2. The circuit of claim 1, wherein the latch logic further comprises:

a latch cycling through a sequence of multiple states.

3. The circuit of claim 2, wherein the latch logic is configurable to cycle through a different number of states before returning to a default state.

4. The circuit of claim 3, wherein configuration of the latch logic is provided by an electrical connection external to a package containing the latch logic.

5. The circuit of claim 1, wherein the latch logic is implement by a multi-state counter.

6. The circuit of claim 1, wherein the latch logic is implement by a flip-flop.

7. The circuit of claim 1, further comprising:

filters coupled to each of the inputs to filter transient signals;

voltage level shift devices coupled to each of the inputs to shift a power supply voltage to a logic level voltage.

8. The circuit of claim 1, further comprising:

protection devices coupled to each of the outputs to protect the circuit from transient signals and overload conditions.

9. A method of controlling an illuminating pushbutton switch using a circuit having inputs receiving a clock control signal and one or both of set and reset control signals and one or more outputs delivering one or more latch output signals, the method comprising:

controlling integrated circuit latch logic with the set and reset control signals;

generating the latch output signals using the latch logic; and selectively connecting the latch output signals to control a condition of the illuminated pushbutton switch, wherein the circuit fits within a housing for the illuminated pushbutton switch within a space sized to hold a snap action switching device, and the inputs and outputs are coupled to external pins from the illuminated pushbutton switch.

10. The method of claim 9, further comprising:

cycling a latch through a sequence of multiple states.

11. The method of claim 10, further comprising:

configuring the latch logic to cycle through a different number of states before returning to a default state.

12. The method of claim 10, further comprising:

configuring the latch logic by an electrical connection external to a package containing the latch logic.

13. The method of claim 9, wherein the latch logic is implemented by a multi-state counter.

14. The method of claim 9, wherein the latch logic is implemented by a flip-flop.

15. The method of claim 9, further comprising:

filtering transient signals at each of the inputs;

shifting a power supply voltage to a logic level at each of the inputs.

16. The method of claim 9, further comprising:

protecting the circuit from transient signals and overload conditions at each of the outputs.

* * * * *